US006219980B1

(12) United States Patent
Peck, Jr.

(10) Patent No.: US 6,219,980 B1
(45) Date of Patent: Apr. 24, 2001

(54) QUICK-ASSEMBLY CORNER PROTECTOR

(75) Inventor: Ronald R. Peck, Jr., Pawling, NY (US)

(73) Assignee: Pawling Corporation, Pawling, NY (US)

( * ) Notice: Subject to any disclaimer, the term of this patent is extended or adjusted under 35 U.S.C. 154(b) by 0 days.

(21) Appl. No.: 09/339,624

(22) Filed: Jun. 24, 1999

(51) Int. Cl.[7] ..... E04B 2/00

(52) U.S. Cl. ..... 52/288.1; 52/290; 52/255; 52/287.1

(58) Field of Search ..... 52/287.1, 288.1, 52/290, 282.1, 232, 255

(56) References Cited

U.S. PATENT DOCUMENTS 3,559,356 2/1971 Koral .
3,712,003 1/1973 Hallock et al. .
4,104,839 8/1978 Balzer et al. .
4,161,853 7/1979 Weiss et al. .
4,430,833 * 2/1984 Balzer et al. ..... 52/255
4,706,426 * 11/1987 Rumsey ..... 52/232

* cited by examiner

*Primary Examiner*—Carl D. Friedman
*Assistant Examiner*—Patrick J. Chavez
(74) *Attorney, Agent, or Firm*—Schweitzer Cornman Gross & Bondell LLP

(57) ABSTRACT

A quick-assembly corner protector including an extruded aluminum retainer adapted to be attached to the corner to be protected; decorative wooden panels laterally, slidingly engaged in the retainer adjacent the corner; and a co-extruded vinyl locking member adapted to hold the panels in place and provide a cushion at the corner.

12 Claims, 2 Drawing Sheets

QUICK-ASSEMBLY CORNER PROTECTOR

BACKGROUND OF THE INVENTION

Corner protectors are well known to the art. Essentially they are protective structures or bumpers adhered or mechanically fastened to walls of high traffic areas to protect walls from being damaged by impacts from rolling carts, wheeled equipment, and the like. Exemplary prior art corner protector assemblies are shown in U.S. Pat. Nos. 5,363,617; 4,903,449; 4,706,426; and 4,196,552.

SUMMARY OF THE PRESENT INVENTION

The present invention is directed to improvements in existing designs. The new corner protector assembly provides for the use of decorative wood panels as a major component of the corner protector assembly. In addition, the design of the invention provides a flush appearance and uniquely combines the aesthetics of wood with impact absorbing characteristics of vinyl. The entire new assembly may be easily and efficiently manufactured employing simple aluminum extrusion techniques, simple vinyl co-extrusion techniques, and simple woodworking techniques. Importantly, installation of the entire new assembly, including wall-mounted aluminum extruded retaining member and wood bumper panels which are slidingly assembled at the corner into the retaining member, is quickly and easily completed by snapping a vinyl cushioning member into the retaining member between the wood bumper panels. Should repair or replacement of the wood panels become necessary, the new design permits quick and easy removal of the panels by simply removing the snap-in cushioning member and sliding the panels out.

More specifically, the new and improved decorative corner guard assembly includes decorative wood panels secured within an elongated extruded aluminum retaining member which is mounted in a recess formed in intersecting walls at a high traffic corner to be protected from impacts by carts or other wheeled equipment. The retaining member is anchored to the intersecting walls of the corner by a suitable adhesive or mechanical fasteners.

In a preferred embodiment of the invention, the retaining member includes locating projections and end wall portions which locate and receive decorative wood bumper panels by lateral sliding engagement and support the panels proximate to the corner. A projecting locking bar is formed at the apex of the retaining member between the bumper panel retaining sections. A resilient co-extruded vinyl locking rail having a hard inner locking clip portion and a softer outer cushioning portion is quickly and easily snapped over the locking bar to complete the assembly. The vinyl locking rail includes biasing wings which engage the inner side walls of the wood bumper panels and contribute to the integrity, rigidity, and stability of the entire assembly. Additionally, the locking rail is contoured to mate with corresponding contoured surfaces on the inner side walls of the bumper panels.

For a better appreciation of the new quick-assembly corner protector, reference should be made to the following detailed description taken in conjunction with the accompanying drawings.

DETAILED DESCRIPTION OF THE INVENTION

Figure 1:
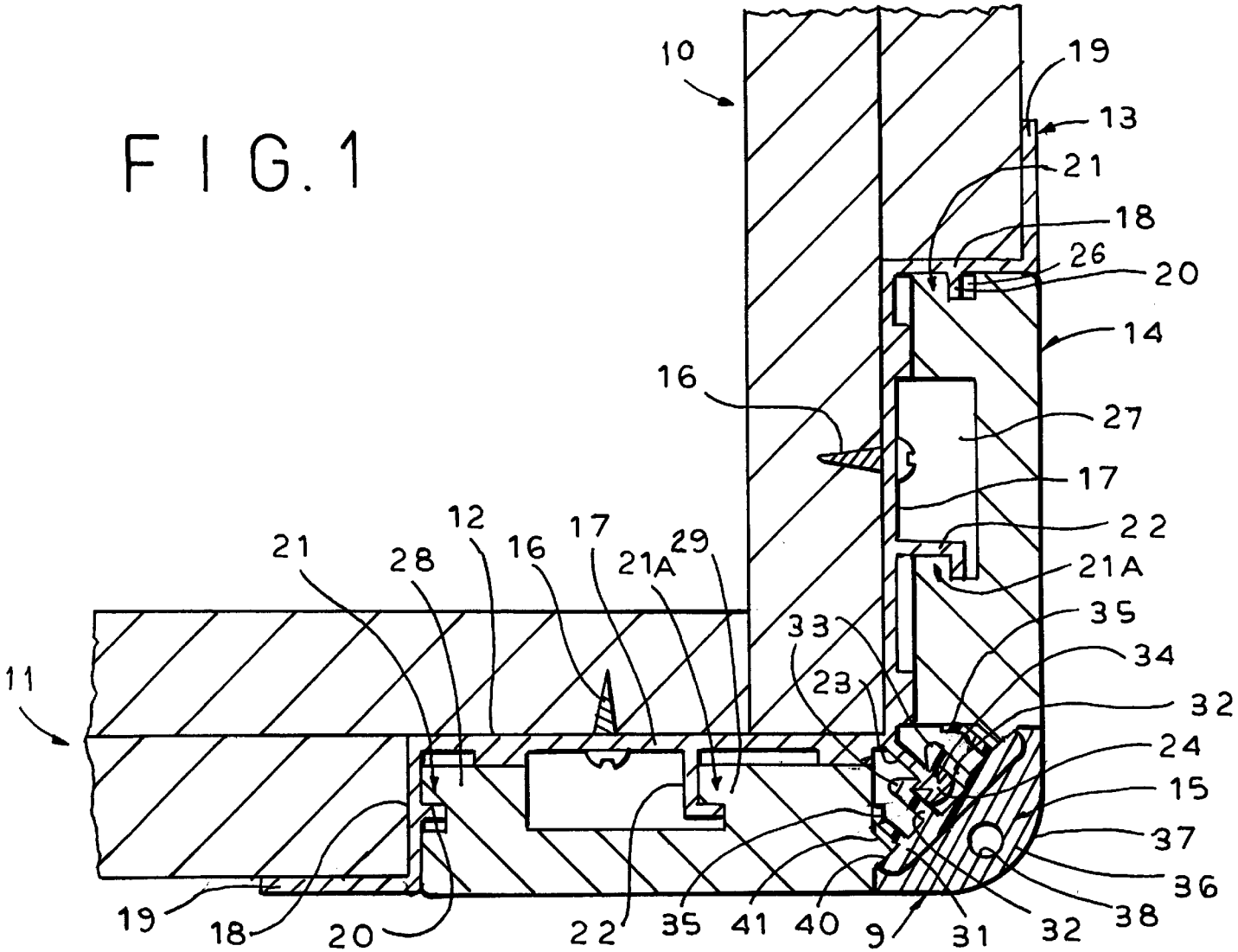
FIG. 1 is a cross-sectional view of a preferred embodiment of the corner protector of the present invention.

Referring now to FIG. 1, the quick-assembly corner guard protector 9 of the present invention is adapted to be mounted at the corner intersection of walls 10, 11 which may be comprised in part of superimposed layers of ⅝ inch gypsum board. At the corner intersection, the outer layer of gypsum board is removed to form a recess 12 into which the corner guard protector assembly may be quickly and easily mounted.

The new and improved corner protector includes an extruded aluminum retainer member 13, a pair of decorative wooden bumper panels 14, and a locking rail 15 which snaps onto the retainer member to complete the entire assembly.

Specifically, the extruded aluminum retainer 13 is secured in a flush relationship with the recess 12 by mechanical fasteners such as screws 16 which pass through holes in inner leg portions 17 which extend for the full length of the recess. Retainer end wall portions 18 project outwardly from the ends of the inner leg portions for the full depth of the recess 12. Advantageously, flanges 19 extend laterally from outermost portions of the retainer and overlap the exposed faces of the gypsum wall portions adjacent the retainer.

In a preferred embodiment of the invention, linear locating projections 20 are formed integrally with the end wall portions 18, and they cooperate with the inner leg portions 17 to define U-shaped grooves 21. Similar U-shaped grooves 21A are formed by L-shaped locating projections 22 formed integrally with inner leg portions 17.

At the right-angled intersection of the inner wall portions 17 a locking bar 23 having a bayonet-like head portion 24 extends outwardly.

As an important aspect of the invention, the decorative bumper panels 14, advantageously fabricated from wood, are milled, sawn, or otherwise shaped and sized to provide recesses 26, 27 which permit the panels 14 to be laterally slid into the retainer 13. Specifically, the creation of the recesses establishes tongue portions 28, 29 which mate with the grooves 21, 21A to mount the panels 14 in the retainer 13.

In a preferred embodiment the invention, the decorative panels 14 are securely locked in place and the corner protector assembly may be quickly and easily completed by snapping the cushioned, locking rail 15 onto the locking bar 23. The rail 15 is formed by a dual durometer co-extruded vinyl having a spine portion 31. A pair of inwardly projecting resilient clip feet 32 having tangs 33 form a clip which is adapted to slide over the locking bar and to lockingly engage shoulders 34 formed thereon. A pair of resilient biasing wings 35 also project inwardly from the spine 31. The wings serve to urge the bumper panels 14 laterally outward against the retainer end walls 18. The locking rail elements 31–35 are all of hard vinyl; however the co-extruded impact cushion 36 supported on the spine 31 is of softer vinyl. As shown the cushion 36 has an arcuate profile 37 and advantageously has a cylindrical hollow interior portion 38 which enhances the deformation and shock absorption characteristics.

The inner edge contours 40 of the locking rail are shaped to correspond precisely with the shaped contours 41 of the bumper panels 14. Thus it will be appreciated that the snapping connection of the locking rail 15 to the locking bar 23 will firmly secure the panels 14 in place in the retainer 13.

As a further important aspect of the invention, should the bumper panels 14 require replacement, the locking rail 15 can be unsnapped from the locking bar 23; the panels can be removed by sliding them laterally out of the retainer 13; substitute panels 14 can be slid in place; and the corner protector 9 can be completely re-assembled by snapping the locking rail 15 back in place over the locking bar 23 in the retainer 13.

Figure 2:
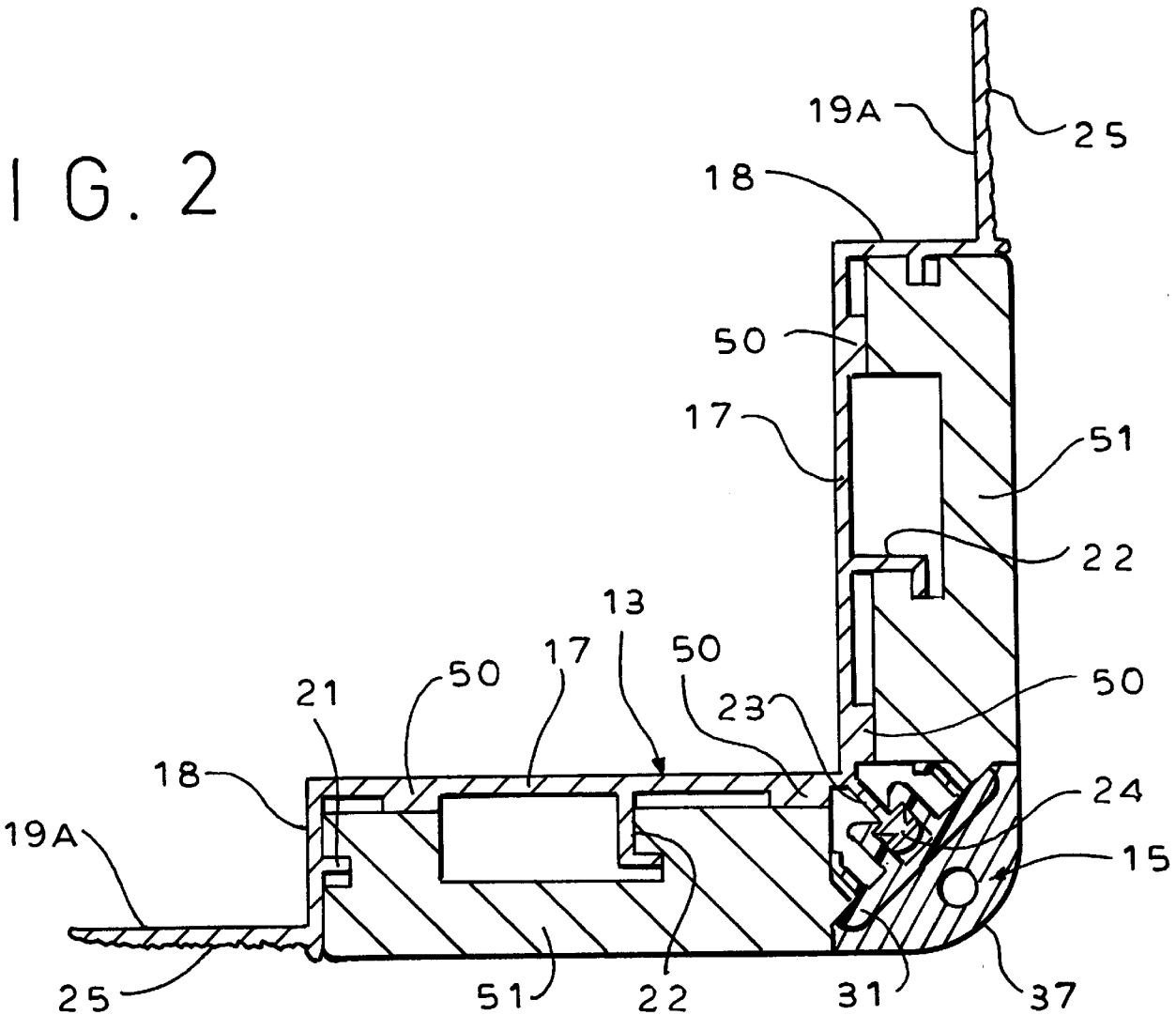
FIG. 2 is a cross-sectional view of an alternative embodiment.

It should be understood that the foregoing description of a preferred embodiment has been exemplary only. The reversal of the male and female locking elements is contemplated, as well as modification of their specific geometries. Thus the male locking bar on the retainer may be alternatively formed as a female clip structure, while the female clip on the locking rail may be alternatively formed as a male locking bar. In addition, it may be desirable or advantageous in certain applications to offset and lengthen the flanges 19 as shown in FIG. 2 where alternate flanges 19*a* are designed to be hidden from view by the application of dry wall paste compound after the retainer 13 is installed in the recess 12. The flanges 19(*a*) are tapered and serrated at surface 25 as shown. In addition, integral spacers 50 may be included on the inner leg portions 17 to mount bumper panels 51 of less than the thickness of the panels 14 and made from materials other than wood.

Although the foregoing description has been given by way of preferred embodiment, it will be understood by those skilled in the art that other forms of the invention falling within the ambit of the following claims is contemplated. Accordingly, reference should be made to the following claims in determining the full scope of the invention.

What is claimed is:

1. A decorative quick-assembly corner guard for protecting a vertical corner formed by intersecting walls, including (A) an elongated extruded retainer having, in cross section, (i) intersecting back wall portions adapted to engage recessed wall portions forming a corner region to be protected;

(ii) end wall portions extending outwardly from the opposite ends of said back wall portions, said end wall portions being substantially equal to the depth of the corner recess;

(iii) panel locating projections extending from said back wall portions and from said end wall portions;

(iv) a first locking means at the intersection of said back wall portions;

(B) (i) decorative bumper panels generally supported in said retainer between said end wall portions and said first locking means and in engagement with said locating projections;

(ii) said bumper panels having recesses formed therein adapted to receive said locating projections and to facilitate lateral sliding insertion of said panels into said extruded retainer;

(C) (i) an extruded, elongated locking rail having a spine, a second locking means, and a pair of flexible biasing wings projecting inwardly from an inner surface of said spine proximate to the ends thereof;

(ii) said second locking means being adapted to engage said first locking means and to secure the locking rail thereto;

(iii) the biasing wings engaging inner side walls of the bumper panels to hold them in place and to urge them laterally toward the retainer end walls;

(iv) the spine also engaging and securing surfaces of the bumper panels; and (v) a co-extruded impact cushioning strip supported by an outer surface of said spine and exposed between said decorative bumper panels.

2. The corner guard of claim 1 in which (a) said first locking means is a locking bar extending outwardly from said retainer;

(b) said second locking means is a clip having a central recess defined by a pair of resilient clip feet projecting inwardly from the inner surface of said spine and being adapted to engage the locking bar.

3. The corner guard of claim 1 in which (a) the bumper panels are fabricated from wood;

(b) the retainer member is aluminum;

(c) the locking rail is vinyl.

4. The corner guard of claim 1 in which (a) said cushioning strip has an elongated hollow portion extending therein.

5. The corner guard of claim 1 which further includes (a) a border flange extending laterally from the side wall portions of said retainer member.

6. The corner guard of claim 5, in which (a) the border flange is offset from the outermost edges of said side wall portions.

7. The corner guard of claim 1 in which (a) said panel locating projections include an L-shaped portion extending from said back wall portions and a linear member extending from said end wall portions;

(b) said locating projections combining with said inner leg portions to define first and second U-shaped retainer grooves;

(c) the bumper panels having first and second tongue portions adapted to engage said first and second retainer grooves.

8. The corner guard of claim 1 in which (a) said bumper panels have contoured inner edges; and (b) said second locking means has contoured surfaces generally congruent with said contoured panel edges.

9. A decorative quick-assembly corner guard for protecting a vertical corner formed by intersecting walls, including (a) an elongated extruded retainer having, in cross section, (i) back wall portions adapted to engage recessed wall portions at said vertical corner, (ii) said back wall portions being joined at an angular intersection, (iii) panel locating surfaces on said back wall portions, (iv) first locking means integral with said retainer and located in the region of said intersection, (b) (i) decorative bumper panels supported on said retainer back wall portions and engaging said locating surfaces, (ii) said bumper panels being positioned on opposite sides of said first locking means, (c) (i) an extruded, elongated locking rail having means for locking engagement with said first locking means in a position intermediate said decorative bumper panels, (ii) said locking rail having surfaces engageable with inner side walls of said bumper panels for securing said bumper panels in said retainer.

10. The corner guard of claim 9 in which (a) said first locking means is a locking bar extending outwardly from the intersection of said retainer back wall portions and generally bisecting the angle between said side wall portions; and (b) said locking rail has a recess for the reception of and gripping engagement with said locking bar.

11. The corner guard of claim 10, in which (a) said locking rail is formed with resilient side walls engageable with inner side walls of said decorative bumper panels for retaining said bumper panels in engagement with said locating surfaces.

12. The corner guard of claim 9 in which (a) said locking rail is formed with a resilient outer surface forming an apex region of said corner guard.

* * * * *